US009932817B1

(12) United States Patent
Kusmer et al.

(10) Patent No.: US 9,932,817 B1
(45) Date of Patent: Apr. 3, 2018

(54) TOOL AND METHOD FOR ACTIVELY COOLING DOWNHOLE ELECTRONICS

(71) Applicant: Vierko Enterprises, LLC of Texas, Houston, TX (US)

(72) Inventors: Daniel Philip Kusmer, Meadows City, TX (US); Nicolas Alejandro Wolk, Houston, TX (US)

(73) Assignee: Vierko Enterprises, LLC, Houston, TX (US)

( * ) Notice: Subject to any disclaimer, the term of this patent is extended or adjusted under 35 U.S.C. 154(b) by 0 days.

(21) Appl. No.: 15/474,665

(22) Filed: Mar. 30, 2017

Related U.S. Application Data

(60) Provisional application No. 62/457,377, filed on Feb. 10, 2017.

(51) Int. Cl.

| | |
|---|---|
| ***E21B 47/01*** | (2012.01) |
| ***E21B 4/02*** | (2006.01) |
| ***F25B 31/02*** | (2006.01) |
| ***F25B 41/06*** | (2006.01) |
| ***F25B 39/00*** | (2006.01) |
| *F25B 39/04* | (2006.01) |
| *F25B 39/02* | (2006.01) |

(52) U.S. Cl.
CPC ..... *E21B 47/011* (2013.01); *F25B 31/023* (2013.01); *F25B 39/00* (2013.01); *F25B 41/062* (2013.01); *E21B 4/02* (2013.01); *F25B 39/02* (2013.01); *F25B 39/04* (2013.01); *F25B 2600/2513* (2013.01)

(58) Field of Classification Search
CPC ..... E21B 36/001; E21B 4/02; E21B 47/011; F25B 1/023; F25B 31/023; F25B 39/00; F25B 41/062
See application file for complete search history.

(56) References Cited

U.S. PATENT DOCUMENTS 3,435,629 A * 4/1969 Hallenburg ..... E21B 36/001 250/261
3,842,596 A * 10/1974 Gray ..... F01D 5/088 165/104.25
5,103,518 A * 4/1992 Gilroy ..... A61G 7/05776 5/713

(Continued)

OTHER PUBLICATIONS

Flores, Aaron G., Thesis (1996): "Active Cooling for Electronics in a Wireline Oil-Exploration Tool" submitted Jun. 1996 to Department of Engineering, Massachusetts Institute of Technology, (212 pgs.).

(Continued)

*Primary Examiner* — Robert E Fuller
*Assistant Examiner* — Christopher J Sebesta
(74) *Attorney, Agent, or Firm* — Jonathan M. Pierce; Porter Hedges LLP

(57) ABSTRACT

A wellbore tool includes a cooling section positioned within the tool for the purpose of maintaining the temperature sensitive components within their rated operating temperature range. The cooling section includes an evaporator, compressor, condenser, power device, expansion device. The compressor is positioned within the condenser. The components whose temperatures are to be maintained are in thermal contact to the evaporator. The cooling process is based upon the vapor compression cycle.

23 Claims, 5 Drawing Sheets

(56) References Cited

U.S. PATENT DOCUMENTS

| | | | | |
|---|---|---|---|---|
| 5,265,677 | A * | 11/1993 | Schultz | E21B 36/001 166/302 |
| 5,701,751 | A | 12/1997 | Flores | |
| 6,769,487 | B2 | 8/2004 | Hache | |
| 7,428,925 | B2 | 9/2008 | Brown et al. | |
| 7,568,521 | B2 | 8/2009 | Brown et al. | |
| 9,366,111 | B2 | 6/2016 | Verma et al. | |
| 2004/0112601 | A1* | 6/2004 | Hache | E21B 36/001 166/302 |
| 2005/0097911 | A1 | 5/2005 | Revellat et al. | |
| 2006/0191682 | A1* | 8/2006 | Storm | E21B 47/011 166/250.01 |

OTHER PUBLICATIONS

Bennett, Gloria A., "Active Cooling for Downhole Instrumentation: Preliminary Analysis and System Selection", Los Alamos National Laboratory report LA-11102-MS, Mar. 1988, (148 pgs.).

Verma, Sandeep et al., "Thermal Management of Electronics Used in Downhole Tools", Society of Petroleum Engineers (SPE 159737), Copyright 2012, (10 pgs.).

Holbein, B. et al., "Status of the Cobold-Project—Cooling of Borehole Objects in Large Depths", Proceedings World Geothermal Congress, Apr. 2015, (8 pgs.).

Dexter Magnetic Technologies; The MagneGear—Efficient Rotary and Linear Magnetic Gearing Devices for Downhole Applications; Apr. 2007; 4 pages.

* cited by examiner

TOOL AND METHOD FOR ACTIVELY COOLING DOWNHOLE ELECTRONICS

CROSS-REFERENCE TO RELATED APPLICATIONS

This application claims priority to U.S. Provisional Application Ser. No. 62/457,377 filed on Feb. 10, 2017, and entitled "TOOL AND METHOD FOR ACTIVELY COOLING DOWNHOLE ELECTRONICS." The priority application is incorporated herein by reference.

BACKGROUND

This disclosure relates generally to methods and apparatus for actively cooling downhole electronics or other component contained within a downhole tool.

Increasingly hotter bore holes (wells) are being encountered in the oil and gas and geothermal industries. Oil and gas wells of 400 F have been encountered in Texas, North Sea, Thailand, and other parts of the world. Geothermal holes are 500 to 600 F. Most commercial available electronics are typically limited to ~250 F maximum. A few electronics have been pushed to high temperatures but the majorities are low temperature. All it takes is one component to be rated at 250 F out of the many other components to have the whole electronics package rated to 250 F. Many electronics suffer drift at elevated temperatures and lose accuracy. Electronic components rated to 400 F will experience shortened life due to the degrading effects of high temperatures. One way to get around these temperature dilemmas is to cool the tool that houses the electronics thus cooling the electronics. The electronics (often referred to as the payload) is often an assembly of many electrical components typically mounted on a printed circuit which is typically mounted on a chassis. Sometimes the electronics consist of an electrical sensor or sensors mounted directly to the chassis and/or housing.

Methods used to cool downhole tools in a high temperature environment can be broadly classified as either passive or active systems. Passive systems have a finite operating time. Passive systems typically start with a cooled tool and provide ways and means to retard (slow down) the heating up of the tool to allow enough time for the tool to complete its job before the tool exceeds its temperature limit. Thermal insulation and devices such as Dewar flasks are a common way to achieve this. Eutectic (phase change) materials and heat sinks are another. However, the time duration is usually only several hours. This is OK for some wireline tools which are tripped into and out the well in a matter of several hours, but this is not good for longer duration wireline tools or drilling tools that are required to stay in the well for several days at a time.

Some passive systems can extend this time by pre-cooling heat sinks (typically in liquid nitrogen) before tripping downhole. Another way is to transport coolants or chemicals downhole to cool the tool but without a way to rejuvenate these materials downhole the time is still limited. The time can be extended by transporting more materials downhole but the large volume requirements make this impractical.

An active system uses work to pump heat out of the tool and into the surrounding environment. This requires power downhole and as long as there is power this cycle go on forever (assuming parts did not wear out). This power is typically derived from the drilling fluid (mud) being continuously circulated in and out of the well, electrical power conducted through a wireline, and/or stored power such as batteries.

Active systems are required for multiple days downhole (i.e. during the drilling process). There are many active systems such as vapor compression refrigeration, Brayton, absorption, Joule-Thompson, thermoacoustic, thermoelectric, magnetocaloric, electrocaloric, etc. Gloria Bennett (Los Alamos National Laboratory) published the pros and cons of these systems in 1988 in her paper Active Cooling for Downhole Instrumentation: Preliminary Analysis and System Selection. The vapor compression refrigeration cycle has many advantages. It is one of the more efficient systems. It has been in use since the early 1800's and is found in refrigerators, homes, buildings, industrial plants, cars, etc. It is a very well understood, simple, and durable system. Coolant can be selected to fit almost any range of temperatures.

Thus, there is a continuing need in the art for methods and apparatus for actively cooling downhole electronics or other component contained within a downhole tool.

SUMMARY

The disclosure describes a downhole tool for cooling a component contained within the downhole tool. The downhole tool comprises a condenser housing configured to transfer heat thereacross. A reciprocating compressor is disposed inside the condenser housing and is surrounded by the condenser housing. The reciprocating compressor includes a cylinder having a cylinder head and a cylinder wall, an inlet port located in the cylinder head, an outlet port located in the cylinder head, and a piston slidable within the cylinder. The downhole tool further comprises an expansion valve configured to convert a high-pressure, high temperature cooling fluid to a low-pressure, low-temperature cooling fluid. The downhole tool further comprises an evaporator tube partially located outside of the condenser housing. The evaporator tube has a first end connected to the expansion valve and a second end connected to the inlet port of the reciprocating compressor. The outlet port of the reciprocating compressor is not connected to the expansion valve by a continuous condenser tube.

In some embodiments, the downhole tool may further comprise a rotating motor disposed outside of the condenser housing. The downhole tool may further comprise a motion converter having an input shaft and an output shaft. A rotary motion of the input shaft may be mechanically converted to a reciprocating motion of the output shaft. The downhole tool may further comprise a first kinematic coupling between the rotating motor and the input shaft of the motion converter. The downhole tool may further comprise a second kinematic coupling between the output shaft of the motion converter and the reciprocating compressor. For example, the input shaft of the motion converter may be magnetically coupled thru the condenser housing to the rotating motor. The rotating motor may be a fluid driven motor. The rotating motor may be an electrical motor. The downhole tool may further comprise a clutch operable to automatically engage or disengage the input shaft of the motion converter to control a temperature range in the evaporator tube. Alternatively, or additionally, the expansion valve may be automated to control a temperature range in the evaporator tube. The downhole tool may further comprise a pickup tube disposed inside the condenser housing and connected to the expansion valve. The pickup tube may have one end open to a chamber of the condenser housing. Alternatively, or additionally, the downhole tool may further comprise coiled vanes extending inwardly from a wall of the condenser housing. The downhole tool may further comprise an evaporator housing. The component to be cooled may be contained within the evaporator housing. The evaporator tube may be at least partially located in the evaporator housing to remove heat from the component. The evaporator housing may include a Dewar flask.

The disclosure also describes a downhole tool that comprises a reciprocating compressor disposed inside of a condenser housing, and a rotating motor disposed outside of the condenser housing. The downhole tool further comprises a motion converter. The motion converter includes an input shaft and an output shaft. A rotary motion of the input shaft is mechanically converted to a reciprocating motion of the output shaft. The downhole tool further comprises a first kinematic coupling between the rotating motor and the input shaft of the motion converter. The downhole tool further comprises a second kinematic coupling between the output shaft of the motion converter and the reciprocating compressor. One of the first and second kinematic couplings is a magnetic coupling thru the condenser housing.

In some embodiments, the downhole tool may further comprise an expansion valve configured to convert a high-pressure, high-temperature cooling fluid to a low-pressure, low-temperature cooling fluid. The downhole tool may further comprise an evaporator tube partially located outside of the condenser housing. The evaporator tube may have a first end connected to the expansion valve and a second end connected to an inlet port of the reciprocating compressor. The rotating motor may be a fluid driven motor. The rotating motor may be an electrical motor. The downhole tool may further comprise a clutch operable to automatically engage or disengage the input shaft of the motion converter to control a temperature range in the evaporator tube. The expansion valve may be automated to control a temperature range in the evaporator tube. The downhole tool may further comprise a condenser tube connected to the reciprocating compressor and to the expansion valve. The downhole tool may further comprise an evaporator housing. The component may be contained within the evaporator housing. The evaporator tube may be at least partially located in the evaporator housing to remove heat from the component. The evaporator housing may include a Dewar flask. The downhole tool may further comprise a pickup tube disposed inside the condenser housing and connected to the expansion valve. The pickup tube may have one end open to a chamber of the condenser housing. The downhole tool may further comprise coiled vanes extending inwardly from a wall of the condenser housing. The downhole tool may further comprise a thermally insulating housing. The component to be cooled may be contained within the thermally insulating housing. The evaporator tube may be at least partially located in the thermally insulating housing to remove heat from the component.

The disclosure also describes a downhole tool that comprises a condenser housing including a wall that surrounds a chamber. A reciprocating compressor is disposed inside the chamber. The reciprocating compressor includes a cylinder having a cylinder head and a cylinder wall, an inlet port located in the cylinder head, an outlet port located in the cylinder head, a piston slidable within the cylinder, and a compression chamber delimited in the cylinder by the piston. The downhole tool further comprises an expansion valve configured to convert a high-pressure, high-temperature cooling fluid to a low-pressure, low-temperature cooling fluid. The downhole tool further comprises an evaporator tube partially located outside of the condenser housing. The evaporator tube has a first end connected to the expansion valve and a second end connected to the inlet port. The expansion valve is disposed across the wall of the condenser housing. The outlet port is open to the chamber.

In some embodiments, the reciprocating compressor may comprise a first check valve connected to the inlet port and configured to prevent flow out of the compression chamber. The reciprocating compressor may comprise a second check valve connected to the outlet port and configured to prevent flow in the compression chamber. The piston may not carry an elastomer seal positioned to seal against the cylinder.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
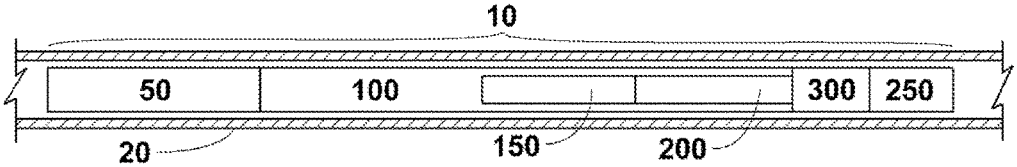
FIG. 1 is a schematic view depicting the sections of a cooling tool inside a drill string.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

All numerical values in this disclosure may be exact or approximate values unless otherwise specifically stated. Accordingly, various embodiments of the disclosure may deviate from the numbers, values, and ranges disclosed herein without departing from the intended scope. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following discussion and in the claims, the terms "including" and "comprising" are used in an open-ended fashion, and thus should be interpreted to mean "including, but not limited to." Furthermore, as it is used in the claims or specification, the term "or" is intended to encompass both exclusive and inclusive cases, i.e., "A or B" is intended to be synonymous with "at least one of A and B," unless otherwise expressly specified herein.

Certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

This disclosure pertains to a vapor compression active cooling system. This system can be used in a wireline or drilling (MWD Measurement While Drilling and/or LWD Logging While Drilling) application, as well as in other applications in high-temperature wells. For brevity, only a drilling application is described below. Those skilled in the art will recognize that replacing the drill collar with a wireline pressure housing and the power unit (turbine) with an electric motor powered by the wireline cable will work equally as well.

A block diagram of a tool 10 is shown in FIG. 1. From left to right it depicts an evaporator 50, a condenser 100, a compressor 150, means to convert rotary to reciprocating motion 200, a magnetic coupling assembly 300, and a power unit (turbine) 250. The tool 10 is typically housed in the lower end of a drill string 20 which is sometimes referred to as a drill collar. Typical drill collar sizes range from 3 to 11 inches outside diameter with a 1.5 to 3 inch bore and 30 feet long. Drill collars that house downhole tools such as tool 10 are typically custom made to specifically fit the size requirement of the tool; therefore the drill collar housing bore and length can vary greatly.

Other tools can be located above the tool 10 such as logging and/or directional tools or below such as rotary steerable systems and/or mud motors. The downhole end of the drill string 20 typically terminates with a drill bit. The tool 10 may be used in wells that can reach depths of 40,000 feet below the surface of the earth, but most wells are typically 5000 to 20,000 feet deep.

Figure 2:
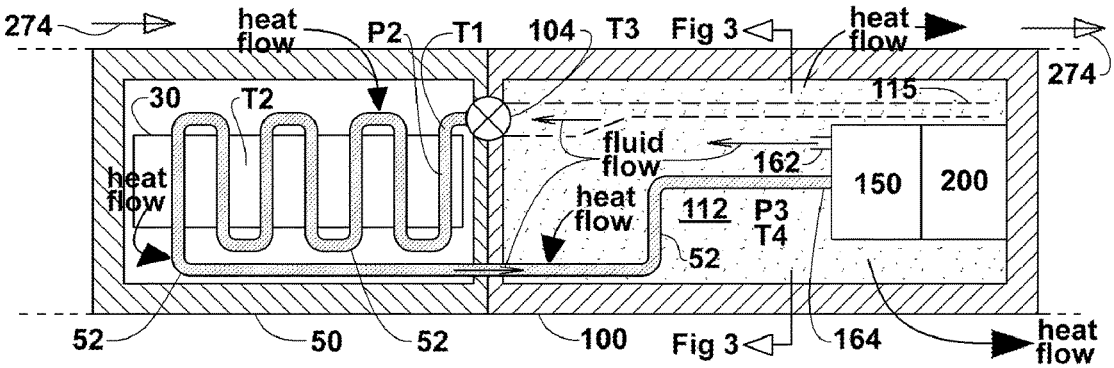
FIG. 2 is a schematic view of a vapor compression refrigeration cycle arrangement.

FIG. 2 shows the schematic of the evaporator 50 and condenser 100 assemblies in greater detail. The letters P and T indicate pressures and temperatures respectively and have the following relationship: P4>P3>P2>P1 and T4>T3>T2>T1. In other words, P4 and T4 are the highest pressure and temperature, and P1 and T1 are the lowest. The compressor 150 compresses the fluid (coolant) coming into the compressor thru inlet port 164 from pressure P2 to P3 which increases the fluid temperature from T2 to T4 converting the fluid 112 into a gas which fills the chamber of condenser 100. Fluid (typically drilling mud) being pumped downhole between the OD of the condenser and ID of the drill string is at temperature T3. Since T4>T3, heat will migrate from inside the condenser to the drilling mud outside the condenser. The loss of heat starts to condense the gas inside the condenser. As the condensate passes through the expansion valve 104 and into the evaporator tube 52, the pressure drops from P3 to P2 and the temperature from T4 to T1. This is known as the Joule-Thomson effect.

The evaporator tube 52 is in thermal contact with the component 30 to be cooled and the atmosphere inside the evaporator 50. For example, the component 30 comprises electronics. Since the component 30 is at temperature T2 and the evaporator tube is at T1, heat will migrate from the component 30 into the evaporator tube. T2 is below the component maximum rated temperature. The atmosphere inside the evaporator 50 is at the same temperature T2 as the component 30. Therefore heat from the drilling mud, which is at temperature T3 and which is flowing over the OD of the evaporator, will migrate thru the wall of the evaporator housing to the atmosphere and eventually to the fluid inside the evaporator tube 52. The evaporator housing is thermally insulated and/or possesses thermally insulating qualities such as a Dewar flask which greatly retards the heat migration through it. The heat which enters the fluid in evaporator tube 52 will cause any liquid to vaporize (boil).

The evaporator tube 52 passes through the wall between the evaporator and condenser housings, through the condenser 100, and into inlet port 164 of the compressor 150. Since the fluid in the condenser is at T4, some heat will migrate into the fluid in the evaporator tube which is at T1 and will vaporize any remaining liquid inside the evaporator tube before entering into the compressor. The fluid inside the evaporator tube which was at pressure P2 gets compressed and discharged out the compressor outlet port 162 and into the condenser chamber which is at pressure P3 and temperature T4. The process then repeats itself.

Figure 3:
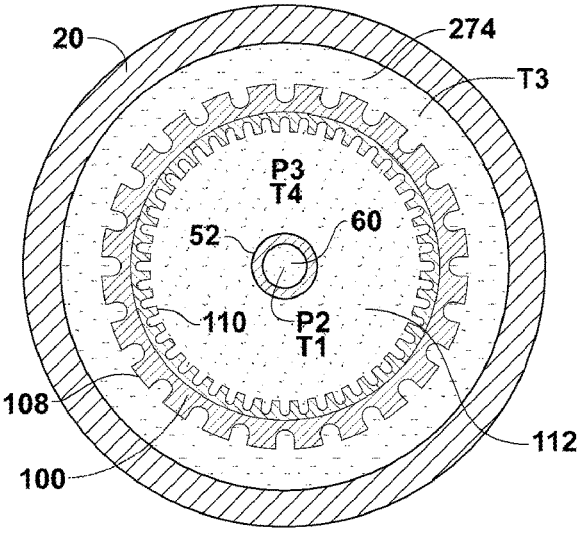
FIG. 3 is a cross cut view through a condenser section of the vapor compression refrigeration cycle arrangement shown in FIG. 2.

There are ways to enhance the heat flow through the walls of condenser housing 102 and into the drilling mud outside of the condenser. FIG. 3 shows a section view through condenser 100, the location of the section plane is shown in FIG. 2. The section view depicts the inside wall 110 and outside wall 108 of the condenser housing lined with longitudinal fins which increase the wall's surface area and thus the heat transfer rate of the heat migrating from fluid 112 inside to annular mud flow 274 outside the condenser container. The view also depicts evaporator tube 52 containing evaporator tube fluid 60 at pressure P2 and temperature T1, surrounded by condenser fluid 112 at pressure P3 and temperature T4.

Figure 4:
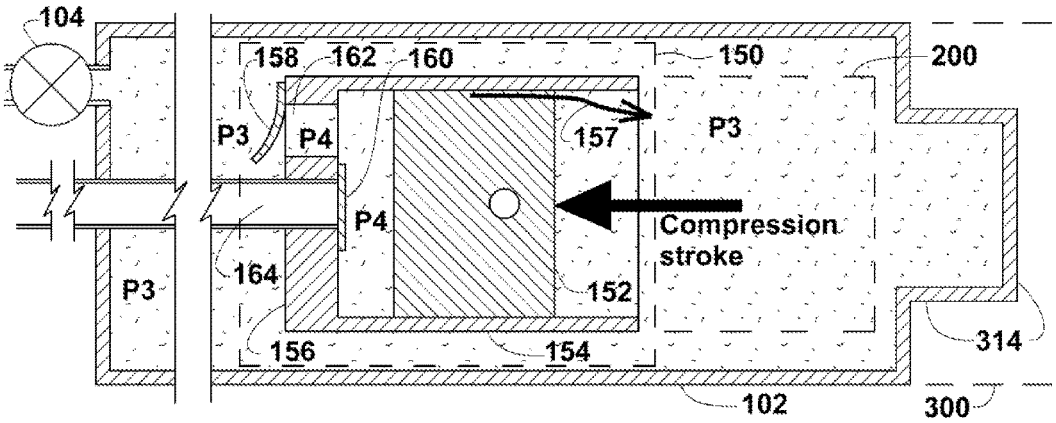
FIG. 4 is a view of the compressor assembly inside the condenser section during a compression stroke.
Figure 7:
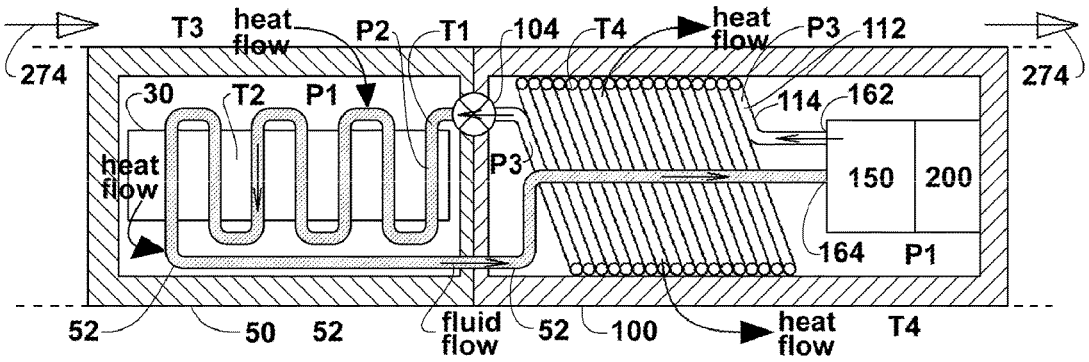
FIG. 7 is a schematic view of an alternative vapor compression refrigeration cycle arrangement.

FIG. 4 shows compressor 150 inside of condenser housing 102 without condenser tube (an example of condenser tube 114 is shown in FIG. 7) and surrounded by condenser fluid 112. This unique arrangement has distinct advantages. First, it allows condenser fluid 112 to make contact with condenser housing 102, for example, direct contact with inner fins on the inner wall 110. This is a more efficient way of transferring heat out of the condenser as compared to the traditional method of capturing the condenser fluid 112 in a condenser tube 114 as shown in FIG. 7. Second, any blow by leakage 157 between cylinder wall 154 and piston 152 gets diluted in the condenser fluid 112 and becomes inconsequential, thus minimizing the need of dynamic seal design. Thus, piston 152 may not carry an elastomer seal positioned to seal against the cylinder wall 154. Third, condenser fluid 112 will wick away heat from compressor 150, keeping the compressor from overheating.

As piston 152 moves towards the left (compression stroke) as shown in FIG. 4 it compresses the fluid in compression chamber 166 to pressure P4. Since P4>P3, outlet valve 158 opens up and the compressed fluid is pumped into condenser housing 102. Valve 158 is located in cylinder head 156 and is depicted as a leaf spring, but there are many other types of valves that may be used, such as check valves, spring loaded poppet valves, cam actuated valves, etc. Because the pressure P4 is only marginally higher than the pressure P3, any blow by leakage 157 may remain minimal, especially compared with other types of compressors that generate a high pressure differential across the piston during the compression stroke.

Figure 5:
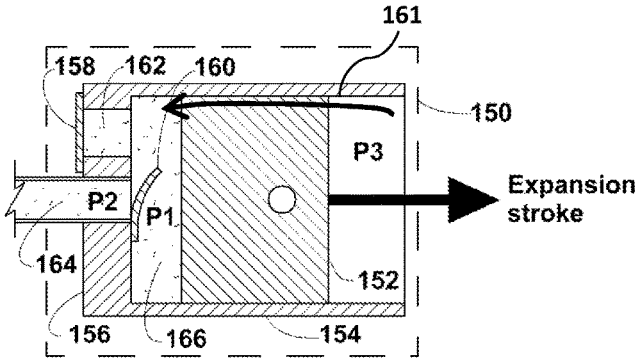
FIG. 5 is a view of the compressor assembly doing an expansion stroke.

FIG. 5 shows compressor 150 in more detail. As piston 152 moves towards the right (expansion stroke) it creates a low pressure P1 in compression chamber 166. Since the fluid in inlet port 164 is at P2 which is greater than P1, inlet valve 160 opens and the fluid from evaporator tube 52 enters the compression chamber. Valve 160 is depicted as a leaf spring, but there are many other types of valves that may be used, such as check valves, spring loaded poppet valves, cam actuated valves, etc. In use, any blow by leakage 161 may decrease the efficiency of the cooling system. However, because inlet valve 160 opens only if the pressure in the compression chamber 166 is lower than pressure P2, any blow by leakage 161 may not pass into the evaporator tube 52. Thus, the configuration of the reciprocating compressor 150 may provide a better efficiency than other types of compressors that are prone to backflow into the evaporator tube 52.

Most wells drilled today have vertical, inclined, and horizontal sections. In the vertical and inclined wells, gravity will force the condensate to collect in the bottom of condenser 100. If the expansion valve 104 is located at the bottom of the condenser the condensate is easily funneled through the valve. If the valve is located at the top of the condenser a pickup tube 115 as shown in FIG. 2 (or other means) may be needed to transport the condensate to the valve. Since P3>P2, pressure will force the condensate up pickup tube 115 and thru expansion valve 104. As shown, the pickup tube 115 has a first end open to the condenser chamber and a second end connected to the expansion valve 104.

Figure 6:
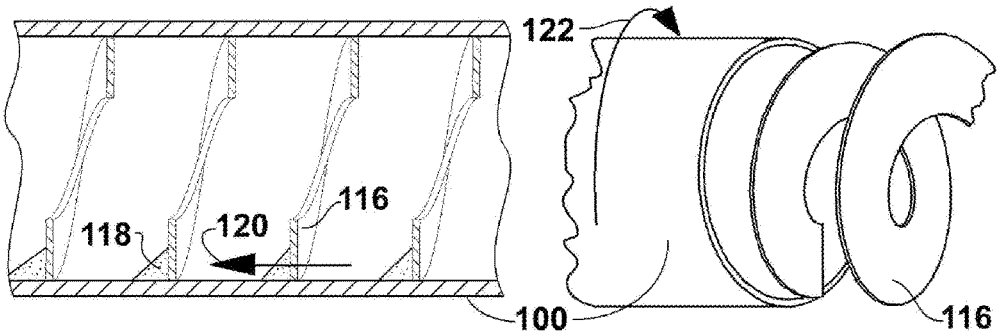
FIG. 6 illustrates a means for collecting and transporting condensate to the expansion valve.

In horizontal wells, a device may be needed to transport the condensate to the end of the condenser containing expansion valve 104. FIG. 6 depicts condenser 100 in a horizontal position with coiled vane 116 extending inwardly from the wall of condenser housing 102 to partway inside the condenser. Due to gravity, condensation 118 will pool into pockets between the vanes as shown in FIG. 6. The condenser housing rotates, as illustrated by arrow 122, since tool 10 which is coupled to drill string 20 rotates. This causes coiled vane 116 to rotate which causes the pooled condensation to traverse in direction 120 and collect at the end of the condenser where expansion valve 104 is located. This concept is known as the Archimedes' screw.

There are basically two types of expansion valves, fixed and variable. The fixed type typically consists of a fixed orifice and/or capillary tube. The variable type is typically automated but can be manual. The automated expansion valve is typically internally equalized but can also be externally equalized. As contemplated in this disclosure expansion valve 104 can be fixed or automated. The automated expansion valve is one way the temperature in the evaporator can be controlled. To a certain degree, the evaporator temperature can be controlled by varying the speed of the compressor which can be controlled by varying the flow rate thru the turbine.

Figure 10:
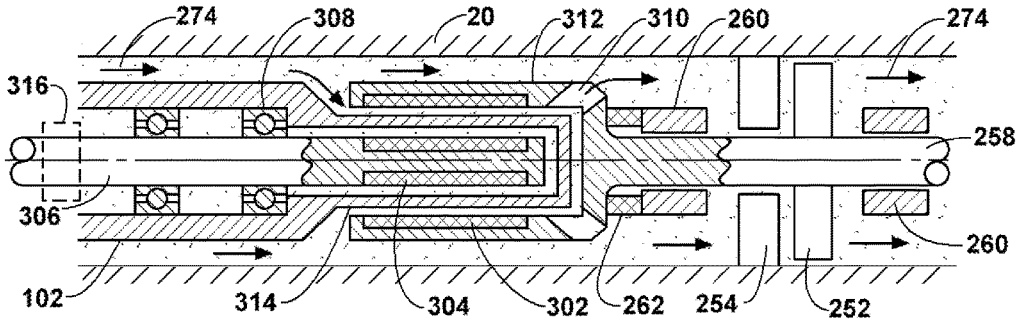
FIG. 10 illustrates a magnetic coupling between a turbine shaft and a compressor shaft through a housing without dynamic (rotary) seals.

As an option, input shaft 306 can run thru clutch 316 (see FIG. 10). A feedback system (not shown) can remotely operate the clutch to engage or disengage the input shaft 306 to the compressor based on the temperature of the evaporator. This is another way the temperature in the evaporator can be controlled.

Using a clutch device and/or automating the expansion valve as described above also has the advantage of adjusting the quality (percent vapor versus liquid) in evaporator tube 52 to an optimized value thus keeping the tool operating at peak efficiency. The automation will also keep evaporator tube 52 from freezing solid thus providing an override protection for the tool.

FIG. 7 shows an alternate arrangement of the condenser 100 components as compared to FIG. 2. Fluid 112 being compressed by compressor 150 and discharged through compressor port 162 is contained within condenser tube 114. The other end of condenser tube 114 is connected to expansion valve 104. The condenser tube is in thermal communication with the condenser wall allowing the heat from the fluid inside the condenser tube to migrate through the condenser housing wall and to annular mud flow 274 outside of the condenser.

Most systems that generate power downhole use a turbine to rotate an electrical generator or alternator. The current derived from the generator powers an electrical motor which can be used to power downhole compressors, pumps, drive mechanisms, etc. Introducing electrical components (the electrical generator and electrical motor) is self-defeating for an active cooling system. These components will limit the temperature rating of the active cooling system, or they will need to be placed into evaporator 50 to keep cool. Placing the electrical generator and motor into the evaporator environment increases the design complications, thus lowers reliability, and places unnecessary heat load on the system.

The system described below is purely mechanical and may not have the temperature dilemmas of electrical components. Piston 152 can derive its power and reciprocating motion from motion converter 200 (rotary to reciprocating) which derives its power from downhole turbine 250 (rotary) which derives its power from annular mud flow 274 (drilling mud) being pumped down drill string 20.

Figure 8A:
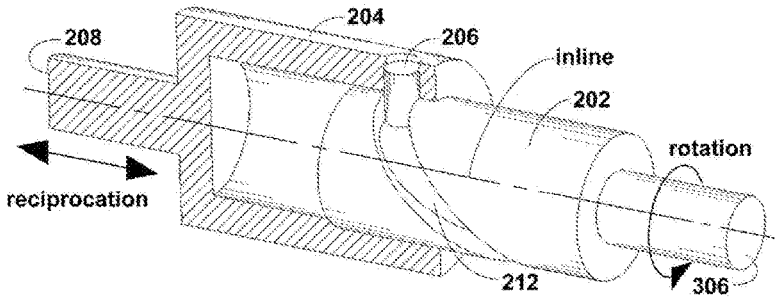
FIG. 8*a* illustrates a means for converting rotary motion into reciprocal motion.
Figure 8B:
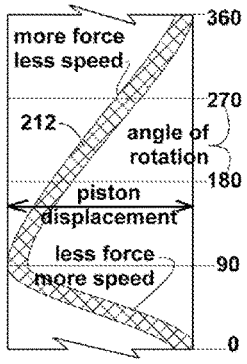
FIG. 8*b* is a diagram illustrating cam path as a function of rotation of the input shaft of the means shown in FIG. 8*a*.
Figure 9A:
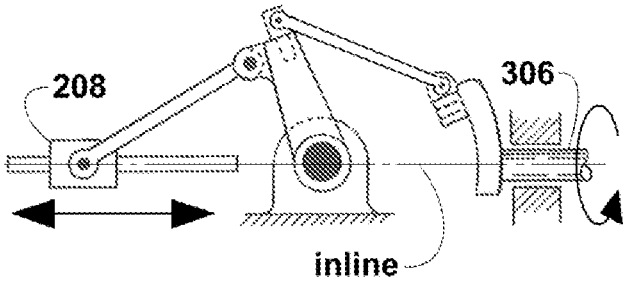
FIGS. 9*a*-9*d* illustrate other means for converting rotary motion into reciprocal motion.
Figure 9B:
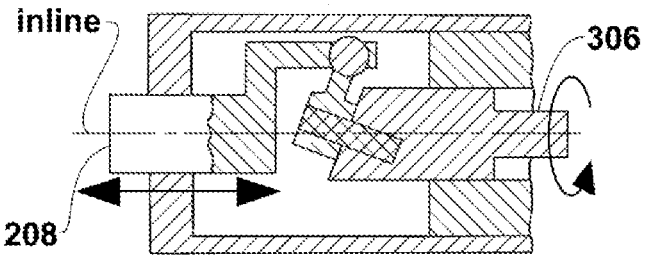
Figure 9C:
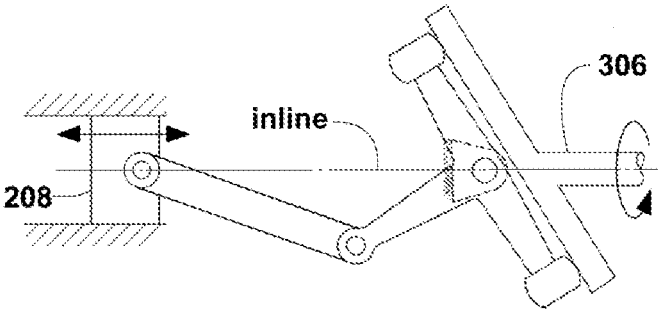
Figure 9D:
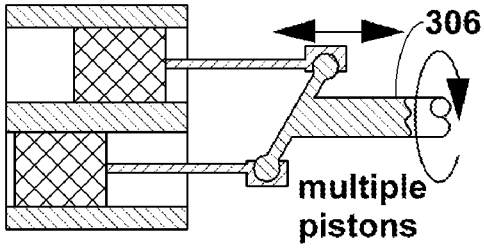

FIG. 8(*a*) shows a preferred configuration of motion converter 200. Piston 152 is attached to cam output shaft 208. The attachment can be solid (no degrees of freedom), spherical (3 degrees of rotational freedom), or pinned (1 degree of rotational freedom), and/or pinned linear (1 degree of rotational and 1 degree of linear freedom). Input shaft 306 rotates cam drive 202 and cam path 212. Cam follower 206 engages the cam path and is forced to reciprocate back and forth in the direction shown in FIG. 8(*a*). The cam follower is rigidly attached to cam housing 204 which is attached to cam output shaft 208. The cam housing can be prevented from rotating about the centerline (inline) via keying, splining, and/or pinning with a slot the cam housing to the compressor and/or condenser housing(s). In some cases, it may be best to let the cam housing rotate while reciprocating to enhance lubricant flow, distribute wear more evenly, and spread out any thermal hot spots.

Cam path 212 can be tailor-made to match the requirements of the compressor. For example, cam path 212 shown in FIG. 8(*b*) shows the piston travelling from bottom dead center (all the way to the right) at 0 degree rotation of the input shaft 306 to top dead center (all the way to the left) at 180 degree rotation and then back to bottom dead center again (all the way to the right) at 360 degree rotation. If the velocity and piston force magnitudes are V and F between 0 and 90, then the velocity and force between 90 and 360 would be ⅓ V and 3 F. An infinite number of cam paths can be tailor made. When used in the embodiment shown in FIGS. 3, 4 and 5, the cam path is preferably tailored to provide a large velocity and low force (such as illustrated between 0 and 90 in FIG. 8*b*) during the compression stroke, and a low velocity and a large force (such as illustrated between 90 and 360 in FIG. 8*b*) during the expansion stroke.

The inline rotation shown in FIG. 8 and FIG. 9 indicates that input shaft 306 is concentric (inline) with cam output shaft 208. This is a very conducive arrangement for downhole tools which are tubular in nature and typically require small diameter housings. Right angle drives, piston crank mechanisms, and other similar arrangements consume valuable space forcing some components (example: piston) to be smaller than optimal. FIG. 9(*a*), (*b*), and (*c*) show alternate configurations of a motion converter from rotary to reciprocal which are inline. FIG. 9(*d*) shows a motion converter (sometimes called a wobble of swash plate) that is similar to FIGS. 9(*b*) and (*c*) but for a multitude of pistons radially spaced around and inline with input shaft 306.

Power for input shaft 306 is derived from annular mud flow 274 (drilling mud) being pumped downhole through drill string 20. Part of the fluid power is converted into rotary power as the fluid passes through one or more stages of turbine stator 254 and turbine rotor 252 blades. The turbine stator is rigidly connected to the drill string, and the turbine rotor is rigidly connected to turbine shaft 258 which is rigidly connected to outer coupling 312. The turbine shaft and thus turbine rotor is supported by turbine radial bearings 260 and turbine thrust bearing 262. Some of the annular mud flow 274 is diverted through the annular space between the outer coupling magnets 302 and coupling barrier 314 and flows out through outer coupling flow ports 310 in order to flush out any debris in the annular space.

Turbine shaft 258 does not pass directly into condenser 100 to power the compressor. If it did, a dynamic seal such as an o-ring or mechanical face seal would be required. Typical pressure differentials across such a dynamic seal could be 20,000 psi or higher and shaft speeds around 2000 rpm. This is a complex design problem and often prone to leaks and failures. Instead, the turbine shaft connects to outer coupling 312 which is embedded with outer coupling magnets 302 as shown in FIG. 10. These magnets are magnetically coupled to input shaft magnets 304 which are embedded in input shaft 306. One revolution of turbine shaft 258 will produce one revolution of the input shaft. In-between the outer coupling magnets and the input shaft magnets is coupling barrier 314. The coupling barrier is an integral part of condenser housing 102 and makes up the right end of the housing as shown in FIG. 10. This eliminates any dynamic (sliding) seal leakage because there is no dynamic seal. The input shaft 306 is supported via radial bearings 308 which are mounted inside condenser housing 102. Magnets used in magnetic couplings in hot applications are typically samarium-cobalt because they retain their magnetic strength up to 1300 F.

Figure 11:
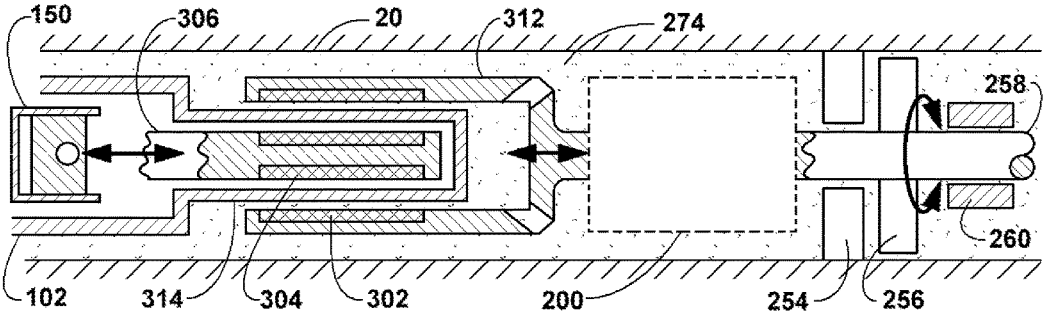
FIG. 11 illustrates an alternative magnetic coupling between a turbine shaft and a compressor shaft through a housing without dynamic (rotary) seals.

FIG. 11 shows an alternate embodiment in which the motion converter 200, which converts rotating motion of its input shaft to reciprocating motion of its output shaft, may be located outside of the condenser housing 102 in the annular mud flow 274. One end of the outer coupling 312 is connected to the motion converter 200. One end of input shaft 306 is connected to the compressor 150. Thus the magnetic coupling assembly between outer coupling magnets 302 and input shaft magnets 304 doesn't have to be a rotary coupling, it can alternatively be a linearly coupling where reciprocating motion of outer coupling magnets 302 drives reciprocating motion of input shaft magnets 304.

While the disclosure is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A downhole tool for cooling a component contained within the downhole tool, comprising:

a condenser housing configured to transfer heat thereacross;

a reciprocating compressor disposed inside of the condenser housing;

a rotating motor disposed outside of the condenser housing;

a motion converter, the motion converter including an input shaft and an output shaft, wherein a rotary motion of the input shaft is mechanically converted to a reciprocating motion of the output shaft, wherein the motion converter is located outside of the condenser housing;

a rotary kinematic coupling between the rotating motor and the input shaft of the motion converter; and a linear kinematic coupling between the output shaft of the motion converter and the reciprocating compressor, wherein the linear kinematic coupling includes a first magnet inside the condenser housing and a second magnet outside the condenser housing.

2. The downhole tool of claim 1, wherein:

the reciprocating compressor is surrounded by high pressure high temperature cooling fluid in the condenser housing, the reciprocating compressor includes a cylinder having a cylinder head and a cylinder wall, an inlet port located in the cylinder head, an outlet port located in the cylinder head, and a piston slidable within the cylinder;

the downhole tool further comprises an expansion valve configured to convert a high pressure high temperature cooling fluid to a low pressure low temperature cooling fluid;

the downhole tool further comprises an evaporator tube partially located outside of the condenser housing, the evaporator tube having a first end connected to the expansion valve and a second end connected to the inlet port, and the outlet port is not connected to the expansion valve by a continuous condenser tube.

3. The downhole tool of claim 2, further comprising a clutch operable to automatically engage or disengage the input shaft to control a temperature range in the evaporator tube.

4. The downhole tool of claim 2, wherein the expansion valve has a variable orifice to control a temperature range in the evaporator tube.

5. The downhole tool of claim 2, further comprising a pickup tube disposed inside the condenser housing and connected to the expansion valve, the pickup tube having one end open to a chamber of the condenser housing.

6. The downhole tool of claim 2, further comprising coiled vanes extending inwardly from a wall of the condenser housing.

7. The downhole tool of claim 2, further comprising an evaporator housing, wherein the component is contained within the evaporator housing, and wherein the evaporator tube is at least partially located in the evaporator housing to remove heat from the component.

8. The downhole tool of claim 7, wherein the evaporator housing includes a Dewar flask.

9. A downhole tool for cooling a component contained within the downhole tool, comprising:

a condenser housing configured to transfer heat thereacross;

a reciprocating compressor disposed inside of the condenser housing;

a rotating motor disposed outside of the condenser housing; a motion converter, the motion converter including an input shaft and an output shaft, wherein a rotary motion of the input shaft is mechanically converted to a reciprocating motion of the output shaft, wherein a rotation axis of the input shaft and a reciprocation direction of the output shaft are inline;

a first kinematic coupling between the rotating motor and the input shaft of the motion converter; and a second kinematic coupling between the output shaft of the motion converter and the reciprocating compressor, wherein one of the first and second kinematic couplings includes a first magnet inside the condenser housing and a second magnet outside the condenser housing.

10. The downhole tool of claim 9, further comprising:

an expansion valve configured to convert a high pressure high temperature cooling fluid to a low pressure low temperature cooling fluid;

an evaporator tube partially located outside of the condenser housing, the evaporator tube having a first end connected to the expansion valve and a second end connected to an inlet port of the reciprocating compressor.

11. The downhole tool of claim 10, further comprising a clutch operable to automatically engage or disengage the input shaft to control a temperature range of the evaporator tube.

12. The downhole tool of claim 10, wherein the expansion valve has a variable orifice to control a temperature range in the evaporator tube.

13. The downhole tool of claim 10, further comprising a condenser tube connected to the reciprocating compressor and to the expansion valve.

14. The downhole tool of claim 10, further comprising an evaporator housing, wherein the component is contained within the evaporator housing, and wherein the evaporator tube is at least partially located in the evaporator housing to remove heat from the component.

15. The downhole tool of claim 14, wherein the evaporator housing includes a Dewar flask.

16. The downhole tool of claim 10, further comprising a pickup tube disposed inside the condenser housing and connected to the expansion valve.

17. The downhole tool of claim 9, further comprising coiled vanes extending inwardly from a wall of the condenser housing.

18. The downhole tool of claim 9, wherein:

the condenser housing includes a wall that surrounds a chamber;

the reciprocating compressor is disposed inside the chamber, the reciprocating compressor including a cylinder having a cylinder head and a cylinder wall, an inlet port located in the cylinder head, an outlet port located in the cylinder head, a piston slidable within the cylinder, and a compression chamber delimited in the cylinder by the piston;

the downhole tool further comprises an expansion valve configured to convert a high pressure high temperature cooling fluid to a low pressure low temperature cooling fluid; and the downhole tool further comprises an evaporator tube partially located outside of the condenser housing, the evaporator tube having a first end connected to the expansion valve and a second end connected to the inlet port, the expansion valve is connected to the chamber, and the outlet port is open to the chamber.

19. The downhole tool of claim 18, wherein the reciprocating compressor comprises:

a first check valve connected to the inlet port and configured to prevent flow out of the compression chamber; and a second check valve connected to the outlet port and configured to prevent flow in the compression chamber, wherein the piston does not carry an elastomer seal positioned to seal against the cylinder.

20. The downhole tool of claim 9, wherein the input shaft and the output shaft are concentric.

21. The downhole tool of claim 9, wherein the motion converter comprises:

a cam drive rotated by the input shaft;

a cam follower engaging a cam path recessed below an outer surface of the cam drive; and a cam housing prevented from rotating and coupled to the output shaft.

22. The downhole tool of claim 21, wherein the cam path is configured to provide a first velocity and a first force during a compression stroke of the reciprocating compressor, and a second velocity and a second force during an expansion stroke of the reciprocating compressor, wherein the first velocity is larger than the second velocity, and the first force is lower than the second force.

23. The downhole tool of claim 9, wherein the motion converter comprises a swash plate.

* * * * *